US009315052B1

(12) United States Patent
Harashina

(10) Patent No.: US 9,315,052 B1
(45) Date of Patent: Apr. 19, 2016

(54) PRINTER AND METHOD OF CONTROLLING A PRINTER

(71) Applicant: TOSHIBA TEC KABUSHIKI KAISHA, Tokyo (JP)

(72) Inventor: Hiromasa Harashina, Numazu Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/882,345

(22) Filed: Oct. 13, 2015

(30) Foreign Application Priority Data

Oct. 17, 2014 (JP) ..... 2014-212706

(51) Int. Cl.
*B41J 13/00* (2006.01)
*B41J 3/407* (2006.01)

(52) U.S. Cl.
CPC ..... *B41J 13/0009* (2013.01); *B41J 3/4075* (2013.01)

(58) Field of Classification Search
CPC ..... B41J 3/4075; B41J 11/008; B41J 3/46; B41J 3/36; B41J 13/0009; H04N 1/00384; H04N 1/00392
See application file for complete search history.

(56) References Cited

U.S. PATENT DOCUMENTS 6,652,172 B2 * 11/2003 Wood ..... B26F 3/12 400/621
7,362,346 B2 * 4/2008 Watanabe ..... B41J 2/32 347/222

OTHER PUBLICATIONS

U.S. Appl. No. 14/691,692, filed Apr. 21, 2015.

* cited by examiner

*Primary Examiner* — Thinh Nguyen
(74) *Attorney, Agent, or Firm* — Patterson & Sheridan, LLP

(57) ABSTRACT

In one embodiment, a printer for printing on labels has a controller that controls how a mount paper is conveyed. The plurality of labels is attached to the mount paper. The controller controls a first conveyance unit and a second conveyance unit such that a feed amount of the mount paper conveyed in a forward direction by the second conveyance unit is smaller than a feed amount of the mount paper conveyed in the forward direction by the first conveyance unit.

18 Claims, 6 Drawing Sheets

PRINTER AND METHOD OF CONTROLLING A PRINTER

CROSS-REFERENCE TO RELATED APPLICATIONS

This application is based upon and claims the benefit of priority from the prior Japanese Patent Application No. 2014-212706, filed on Oct. 17, 2014, the entire contents of which are incorporated herein by reference.

FIELD

The embodiments described below generally relate to a printer and a method of controlling a printer.

BACKGROUND

In the prior art, a printer such as a bar code printer that conveys a label roll paper (e.g., a mount paper to which a plurality of labels are attached) and prints on the labels is known. The printer includes a peeling unit that peels printed labels of the label roll paper from the mount paper of the label roll paper. The peeling unit bends the label roll paper at a sharp angle by using a peeling bar, for example, and thereby peels a printed label from the mount paper. When the peeling unit peels the printed label, the printer conveys the mount paper, from which the label is peeled, at the conveyance speed of the label roll paper or more. The printer stops conveyance of the label roll paper and conveyance of the mount paper, from which the label is peeled, where the tail edge portion of the label remains on the peeling bar. This is the end of peeling the label by the peeling unit. In other words, the label is peeled from the mount paper except for the tail edge portion. The printer detects presence/absence of the label that is peeled (peeled label) inside of the printer by using a sensor. For example, when a user draws the peeled label from the printer to completely peel the peeled label from the mount paper, the printer detects no peeled label inside of the printer by using the sensor. If there is print data to be printed next, the printer detects no peeled label, and after a predetermined time period passes, conveys the mount paper of the label roll paper in the reverse direction in order to return the next label of the label roll paper to the print start position. After conveying the mount paper in the reverse direction, the printer prints on the next label.

However, when a user draws the peeled label from the printer, in the peeling unit, the mount paper from which the label is peeled, is stretched. In this case, the front edge portion of the peeling bar sometimes bends the mount paper, from which the label is peeled. In this case, if the printer prints on a label after conveying the mount paper in the reverse direction, since the mount paper, from which the label is peeled, is bent, a contact load between the peeling bar and the mount paper is varied. As a result, the mount paper, from which the label is peeled, may be conveyed inconsistently, and printing failures may occur.

DETAILED DESCRIPTION

According to one embodiment, a printer includes a first conveyance unit, a peeling unit, a second conveyance unit, and a controller. The first conveyance unit conveys a mount paper, the plurality of labels being attached to the mount paper. The peeling unit peels a printed label out of the plurality of labels, from the mount paper. The second conveyance unit conveys the mount paper, the printed label having been peeled from the mount paper by the peeling unit. The controller controls the first conveyance unit and the second conveyance unit such that a feed amount of the mount paper conveyed in a forward direction by the second conveyance unit is smaller than a feed amount of the mount paper conveyed in the forward direction by the first conveyance unit.

Figure 1:
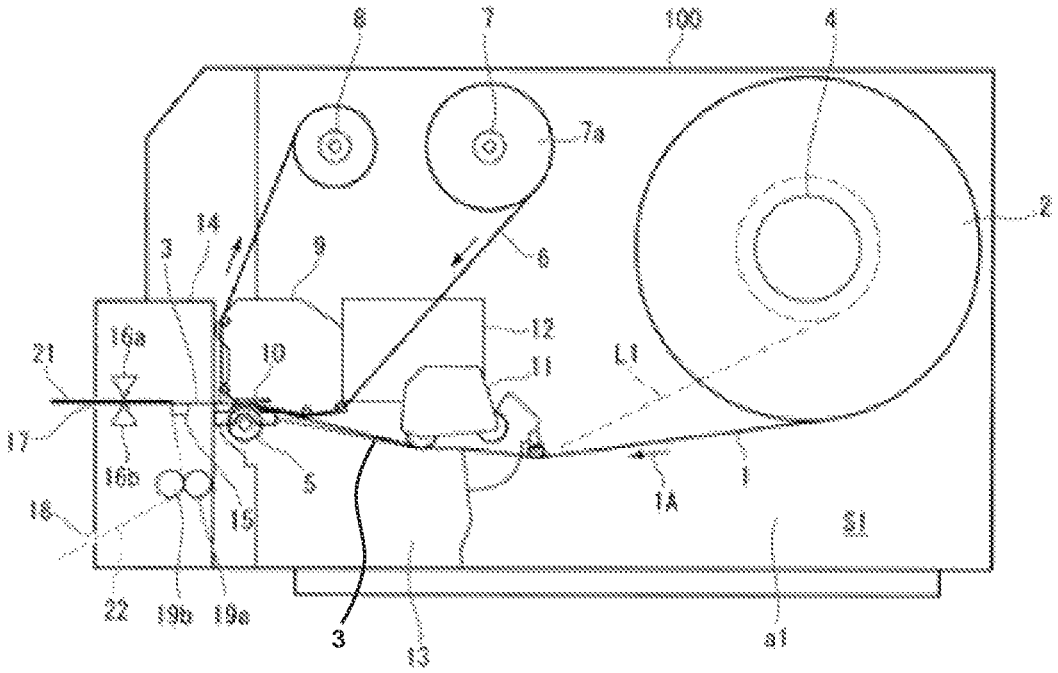
FIG. 1 is a side view showing an example of an internal structure of a printer of an embodiment.
Figure 2:
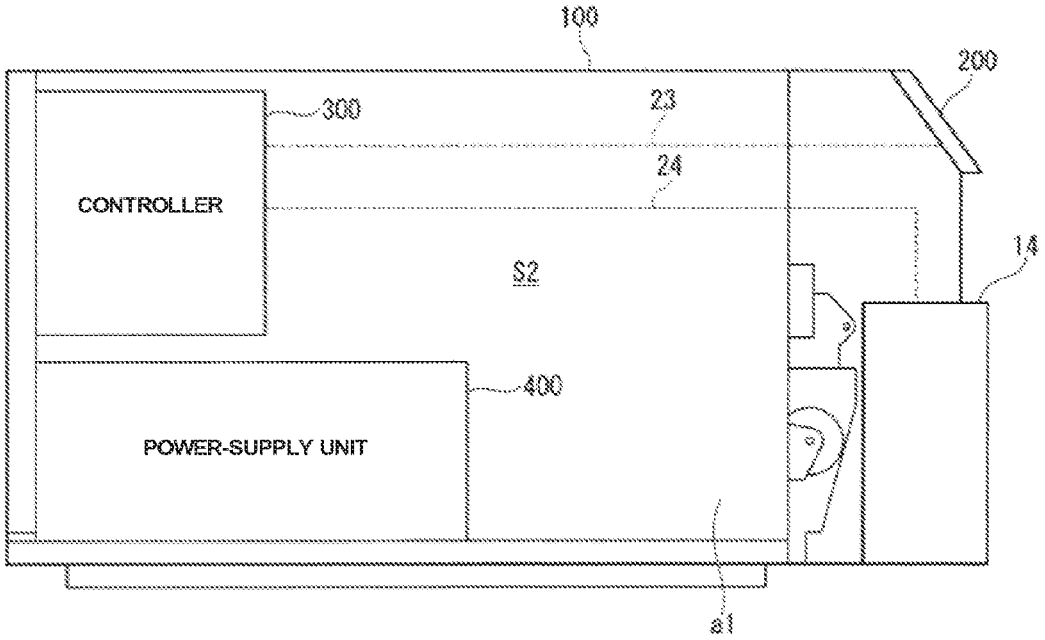
FIG. 2 is a side view showing an example of an internal structure of the printer of the embodiment.

Hereinafter, the printer 100 of this embodiment will be described with reference to the drawings. In the drawings, the same reference symbols show the same or similar sections. Each of FIG. 1 and FIG. 2 is a side view showing, as an example, the internal structure of the printer 100 of this embodiment. FIG. 1 and FIG. 2 are diagrams showing the internal structure of the printer 100 seen in different sides. As shown in FIG. 1 and FIG. 2, the printer 100 includes the first chamber S1 and the second chamber S2 in the housing. The first chamber S1 is divided from the second chamber S2 by the vertical wall a1. First, with reference to FIG. 1, the internal structure of the first chamber S1 will be described.

The printer 100 holds the roll unit 2, which is obtained by winding the label roll paper 1 in a rolled manner, by using the roll holder shaft 4 (described later). The label roll paper 1 is paper in which a plurality of labels are attached to belt-type mount paper. In other words, the label roll paper 1 is belt-type mount paper to which a plurality of labels are attached. The printer 100 draws the label roll paper 1 from the roll unit 2, and conveys the label roll paper 1 in the direction of the print head 10 (described later) to print on the labels of the drawn label roll paper 1. The printer 100 further conveys the printed label roll paper 1 to the peeling unit 14 (described later) to peel the printed labels from the mount paper. The printer 100 further conveys the mount paper, from which the printed labels are peeled, in the direction of the second outlet 18 (described later). In the following description, the forward direction means the conveyance direction of the label roll paper 1 to the print head 10 and the peeling unit 14 and the conveyance direction of the mount paper, from which the labels are peeled, in the direction of the second outlet 18. Further, in the following description, the backward direction means the conveyance direction of the label roll paper 1 and the mount paper, from which the labels are peeled, opposite to the above-mentioned forward direction. The label roll paper 1 and the mount paper, from which the labels are peeled, are conveyed during the rotation of the platen roller 5 and the feed roller 19*a* (described later). In the following description, the positive rotational direction means the rotational direction of the platen roller 5 and the feed roller 19*a* when the label roll paper 1 and the mount paper, from which the labels are peeled, are conveyed in the forward direction. In the following description, the negative rotational direction means the rotational direction of the platen roller 5 and the feed roller 19*a* when the label roll paper 1 and the mount paper, from which the labels are peeled, are conveyed in the backward direction. The printer 100 conveys the label roll paper 1 in the forward direction, and at the same time, prints, for example, bar codes on the labels of the label roll paper 1 based on print data (data to be printed). In the label roll paper 1, the plurality of labels are attached on the mount paper in the forward direction. The printer 100 prints on the labels in series in the forward direction from the label at the downstream side.

FIG. 1 shows, as an example, inwardly-rolled label roll paper, in which the label roll paper 1 is wound up in the roll unit 2 where the labels are inside of the mount paper. Note that, in the roll unit 2 of FIG. 1, the solid line shows that the diameter of the roll unit 2 is relatively large, i.e., that a larger amount of the label roll paper 1 is remained. Meanwhile, in the roll unit 2 of FIG. 1, the dot-and-dash line L1 shows that the diameter of the roll unit 2 is relatively small, i.e., that a smaller amount of the label roll paper 1 is remained. Further, in FIG. 1, the arrow 1A shows the conveyance direction of the label roll paper 1 in the forward direction.

As shown in FIG. 1, the printer 100 includes, in the first chamber S1, the roll holder shaft 4, the platen roller 5 as a first conveyance unit, the supply shaft 7 of the ink ribbon 6, the wind-up shaft 8 of the ink ribbon 6, the head block 9, the print head 10, and the roller block 11. The roll holder shaft 4, the platen roller 5, the supply shaft 7, the wind-up shaft 8, the head block 9, the print head 10, and the roller block 11 are mounted on the first chamber S1, in which they are approximately perpendicular to the vertical wall a1. The printer 100 further includes, in the first chamber S1, the movable block 12. The movable block 12 is a movable unit integrally including the head block 9 and the roller block 11.

The printer 100 further includes, in the first chamber S1, the fixed block 13. The fixed block 13 includes the platen roller 5. The movable block 12 faces the fixed block 13. The conveyer path 3 is provided between the movable block 12 and the fixed block 13, and conveys the label roll paper 1. The roll holder shaft 4 holds the roll unit 2, for which it is possible to draw the label roll paper 1 from the roll unit 2. Specifically, the roll holder shaft 4 rotatably holds the roll unit 2 of the label roll paper 1 around the shaft perpendicular to the vertical wall a1. The roll holder shaft 4 and the roll unit 2 are not driven by a motor or the like. The roll unit 2, which is held by the roll holder shaft 4, is rotated when the platen roller 5 rotates. When the roll unit 2 is rotated, the label roll paper 1 is drawn from the roll unit 2.

The platen roller 5 as the first conveyance unit is rotated by a rotary drive mechanism (not shown) including a motor (not shown) such as a stepping motor, gears, a belt, and the like. The platen roller 5 faces the print head 10. An elastic member (not shown) biases the print head 10 toward the platen roller 5 side. The biased print head 10 presses the drawn label roll paper 1 against the platen roller 5. According to this structure, the platen roller 5 and the print head 10 hold the drawn label roll paper 1 therebetween. When printing, the platen roller 5 draws the label roll paper 1 from the roll unit 2, and rotates in the positive rotational direction in order to convey the drawn label roll paper 1 on the conveyer path 3 in the forward direction (see FIG. 4). When back-feeding (described later), the platen roller 5 rotates in the negative rotational direction in order to convey the label roll paper 1 on the conveyer path 3 in the backward direction (see FIG. 4).

The supply shaft 7 of the ink ribbon 6 rotatably holds the roll unit (hereinafter, referred to as "ribbon roll") 7*a* of the ink ribbon 6 set by a user. The wind-up shaft 8 is rotated by a rotary drive mechanism (not shown) including a motor (not shown), gears, a belt, and the like, and winds up the ink ribbon 6. When the wind-up shaft 8 winds up the ink ribbon 6, the ink ribbon 6 is drawn from the ribbon roll 7*a*. The print head 10 and the platen roller 5 hold the ink ribbon 6 and the label roll paper 1 together therebetween.

In FIG. 1, the print head 10 is above the platen roller 5 and faces the platen roller 5. The print head 10 prints, for example, bar codes on the labels attached on the mount paper of the label roll paper 1, which is drawn by the platen roller 5, based on print data. The print head 10 is capable of being attached to and detached from the platen roller 5, and biased by an elastic member toward the platen roller 5. Thanks to the elastic member, the biased print head 10 presses the label roll paper 1, which is conveyed between the print head 10 and the platen roller 5, against the platen roller 5. The print head 10 is a thermal head, which includes, for example, a plurality of heater elements arrayed in series, and selectively energizes the plurality of heater elements to cause the heater elements to generate heat. The print head 10 melts or sublimates the ink on the ink ribbon 6 when the heater elements generate heat, and thereby transfers the ink to the labels attached to the mount paper of the label roll paper 1 to print. In the following description, the print mechanism means a mechanism including the platen roller 5, the ink ribbon 6, the supply shaft 7, the wind-up shaft 8, the rotary drive mechanism, the print head 10, and a motor controller (not shown). Further, the printer 100 includes, in the first chamber S1, the peeling unit 14. The peeling unit 14 is a device that peels printed labels from the mount paper of the label roll paper 1 conveyed from the conveyer path 3. The peeling unit 14 includes the peeling bar 15, the sensor 16*a*, the sensor 16*b*, the first outlet 17, the second outlet 18, the feed roller 19*a* as a second conveyance unit, and the pinch roller 19*b*.

The peeling bar 15 is a plate member, and is at the downstream position of the print head 10 of the print mechanism in the front direction of the print mechanism, i.e., the forward direction of the label roll paper 1. The peeling unit 14 peels the labels printed by the print head 10 from the mount paper of the label roll paper 1 by using the peeling bar 15. Specifically, when the peeling unit 14 peels the labels, the platen roller 5 and the feed roller 19*a* (described later) are rotated in the positive rotational direction. As a result, the label roll paper 1 (mount paper on which printed labels are attached) is conveyed to the peeling bar 15. The peeling unit 14 bends the conveyed label roll paper 1 at a sharp angle by using the peeling bar 15, and thereby peels the printed labels of the label roll paper 1 from the mount paper of the label roll paper 1. The platen roller 5 and the feed roller 19*a* stop rotation at different times (described later) at a time when the tail edge portion of a label reaches the peeling bar 15 and the front edge portion of the label is exposed from the first outlet of the printer 100. The peeling unit 14 stops peeling when the platen roller 5 and the feed roller 19*a* stop rotation. As a result, the printed label 21 (see FIG. 5, described later) peeled by the peeling unit 14 stops on the conveyer path 3, in which the tail edge portion of the label remains on the peeling bar and the front edge portion of the label is exposed from the first outlet of the printer 100. Hereinafter, the printed-and-peeled label 21 will be referred to as peeled label 21. The peeled label 21 that stops on the conveyer path 3 is peeled from the mount paper of the label roll paper 1 except for the tail edge portion. After the printer 100 finishes printing, a user holds the exposed front edge portion of the peeled label 21 and can draw the peeled label 21 from the printer 100. When the peeled label 21 is drawn from the printer 100, the peeled label 21 is peeled from the mount paper of the label roll paper 1 completely. In the following description, the waiting state of the printer 100 until the peeled label 21 is drawn by a user will sometimes be referred to as waiting state to wait for the peeled label 21 to be peeled.

The sensor 16*a* is a light-emitting unit that emits light. The sensor 16*b* is a light-receiving unit that receives light emitted from the sensor 16*a*. The sensor 16*b* outputs a voltage, the level of which corresponds to the amount of received light. The sensor 16*a* and the sensor 16*b* are used to detect presence/absence of the peeled label 21 on the conveyer path 3. Note that, in the following description, if it is not necessary to distinguish between the sensor 16*a* and the sensor 16*b*, each of the sensor 16*a* and the sensor 16*b* will be referred to as sensor 16. In this embodiment, the sensor 16 is a transmission sensor but may be a reflective sensor.

The first outlet 17 is an outlet from which the peeled labels 21 are discharged. The second outlet 18 is an outlet from which the mount paper 22, from which the labels are peeled by the peeling bar 15 (see FIG. 5, described later), is discharged. Hereinafter, the mount paper 22, from which labels are peeled, will be referred to as peeled mount paper 22. The feed roller 19*a* is rotated by a rotary drive mechanism (not shown) including a motor (not shown) such as a stepping motor, gears, a belt, and the like. The feed roller 19*a* faces the pinch roller 19*b*. According to this structure, the feed roller 19*a* and the pinch roller 19*b* hold the peeled mount paper 22 therebetween. When the peeled mount paper 22 is conveyed to the second outlet 18, the feed roller 19*a* is rotated in the positive rotational direction (see FIG. 4) to convey the peeled mount paper 22 in the forward direction in cooperation with the pinch roller 19*b*. In back-feeding (described later), the feed roller 19*a* is rotated in the negative rotational direction (see FIG. 4) to convey the peeled mount paper 22 in the backward direction.

Next, with reference to FIG. 2, the internal structure of the second chamber S2 of the printer 100 will be described. With reference to FIG. 2, the printer 100 includes the controller 300 and the power-supply unit 400 in the second chamber S2. The controller 300 controls the overall behavior of the printer 100. For example, the controller 300 controls rotation of the platen roller 5 and the feed roller 19*a*, and thereby controls how the label roll paper 1 is conveyed. For example, when printing, the controller 300 rotates the platen roller 5 and the feed roller 19*a* in the positive rotational direction. For example, when back-feeding (described later), the controller 300 rotates the platen roller 5 and the feed roller 19*a* in the negative rotational direction.

Further, the controller 300 controls the print mechanism, and thereby prints, for example, bar codes on labels of the label roll paper 1 based on print data. Note that, in general, the controller 300 controls rotation of the feed roller 19*a* and the platen roller 5 such that the conveyance speed of the peeled mount paper 22 conveyed by the feed roller 19*a* is higher than the conveyance speed of the mount paper, on which labels are attached, conveyed by the platen roller 5 in printing and in back-feeding. Further, although not shown in FIG. 2, the motor and the rotary drive mechanism are mounted on the second chamber S2. The power-supply unit 400 supplies power to the printer 100. The printer 100 further includes the display unit 200. In FIG. 2, the dotted line 23 shows a path of data transmitted between the display unit 200 and the controller 300. The dotted line 24 shows a path of data transmitted between the controller 300 and the peeling unit 14.

The display unit 200 is an image display device such as a liquid crystal display or an organic EL (Electro Luminescence) display. The display unit 200 functions as an output interface, and displays letters and images. Further, the display unit 200 functions as an input interface, and receives instruction information input by a user. The instruction information input in the display unit 200 is transmitted to the controller 300.

Next, how the printer 100 of this embodiment behaves will be described roughly. The printer 100 rotates the platen roller 5 and the feed roller 19*a* in the positive rotational direction, thereby conveys the label roll paper 1 to the print head 10, and prints on labels based on print data. The printer 100 further rotates the platen roller 5 and the feed roller 19*a* in the positive rotational direction, and thereby conveys the printed label to a predetermined peeling position on the conveyer path 3. When the printed label is conveyed to the peeling position, the printer 100 controls rotation of the platen roller 5 and the feed roller 19*a*, and thereby stops conveying the printed label. The peeling position is a predetermined position on the conveyer path 3, and is specifically the position of the peeled label 21 on the conveyer path 3, at which the tail edge portion of the peeled label 21 remains on the peeling bar 15. When the peeled label 21 stops at the peeling position, the printer 100 stops rotation of the platen roller 5 after a predetermined time period passes after the feed roller 19*a* is stopped. Since rotation of the platen roller 5 and rotation of the feed roller 19*a* are controlled as described above, the peeled mount paper 22 of the label roll paper 1 can be slack near the peeling bar 15 (see FIG. 5, described later). The controller 300 controls the rotation. Hereinafter, the controller 300 will be described in detail.

Figure 3:
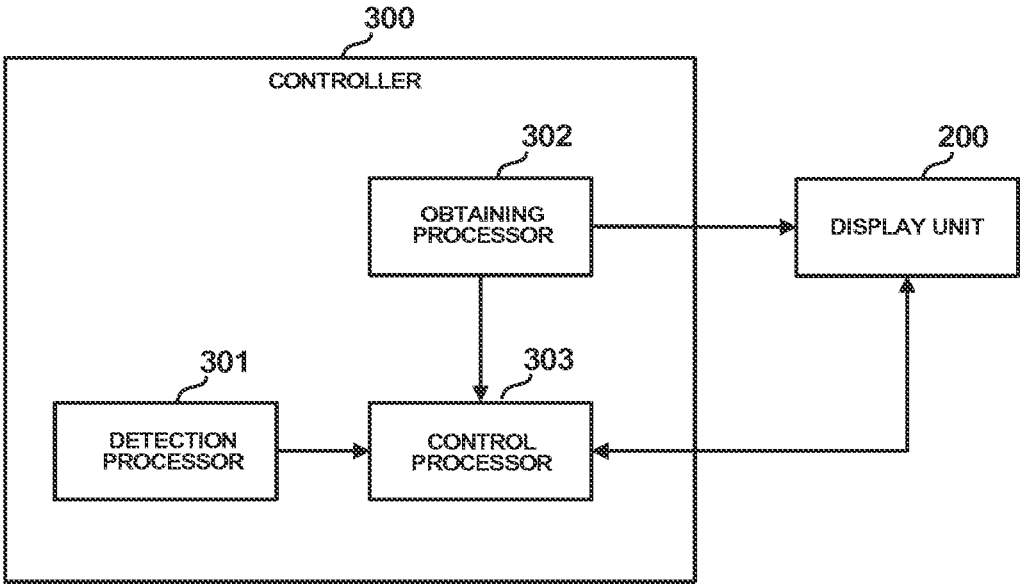
FIG. 3 is a block diagram showing the functional structure of the controller of the printer of the embodiment.

FIG. 3 is a block diagram showing the functional structure of the controller 300. The controller 300 includes a CPU (Central Processing Unit), a memory, an auxiliary storage, and the like connected via a bus. The controller 300 executes a control program recorded in the memory. The controller 300 functions as an apparatus including the detection processor 301, the obtaining processor 302, and the control processor 303 by executing a control program. Note that all of or part of the functions of the controller 300 may be realized by using hardware such as ASIC (Application Specific Integrated Circuit), PLD (Programmable Logic Device), or FPGA (Field Programmable Gate Array). Further, the control program may be recorded in a non-transitory computer readable recording medium. Examples of the non-transitory computer readable recording medium include portable media such as a flexible disk, a magneto-optical disk, a ROM, and a CD-ROM, a recording device such as a hard disk housed in a computer system, and the like. Alternatively, the control program may be transmitted/received via telecommunication lines.

The detection processor 301 detects labels attached to the mount paper of the label roll paper 1 conveyed on the conveyer path 3 based on gaps between the labels detected by a gap sensor (not shown). The gap has a length from the tail edge of a certain label (for example, first label) attached to the mount paper of the label roll paper 1 to the front edge of an attached label (for example, second label) next to the first label. The gap sensor is provided between the peeling bar 15 and the print head 10. Further, the detection processor 301 detects presence/absence of the peeled label 21 based on a voltage level output from the sensor 16*b*. Specifically, if the voltage level is smaller than a predetermined threshold, the detection processor 301 detects that the peeled label 21 is on the conveyer path 3. Meanwhile, if a voltage level is equal to or larger than the predetermined threshold, the detection processor 301 detects that no peeled label 21 is on the conveyer path 3. The obtaining processor 302 obtains instruction information input by a user via the display unit 200. The instruction information includes, for example, an instruction for issuing labels, and information such as a label size. To issue labels means to print bar codes and the like on labels and output the labels.

The control processor 303 controls the functional processors 301-303 of the controller 300, the platen roller 5, and the feed roller 19*a*. For example, the control processor 303 controls the platen roller 5 and the feed roller 19*a* such that the feed amount of the peeled mount paper 22 conveyed in the forward direction is less than the feed amount of the label roll paper 1 (mount paper to which labels are attached) conveyed in the forward direction. The feed amount of the peeled mount paper 22 is the total amount (length of mount paper) of the peeled mount paper 22 conveyed in the forward direction by the feed roller 19*a*. The feed amount of the label roll paper 1 is the total amount (length of mount paper) of the label roll paper 1 (mount paper to which labels are attached) conveyed in the forward direction by the platen roller 5. The feed amount is obtained for each of the platen roller 5 and the feed roller 19*a*. The feed amount is obtained by, when the peeled mount paper 22 and the label roll paper 1 are conveyed in the backward direction, subtracting the feed amount of conveyance in the backward direction from each feed amount of conveyance in the forward direction. As described above, the peeled mount paper 22 is conveyed by the feed roller 19*a*. As described above, the label roll paper 1 (mount paper to which labels are attached) is conveyed by the platen roller 5. For example, after a predetermined time period passes after conveyance of the peeled mount paper 22 by the feed roller 19*a* is stopped, the control processor 303 stops conveying the label roll paper 1 by the platen roller 5. Further, the control processor 303 previously records the distance between the peeling bar 15 and the print head 10.

Figure 4:
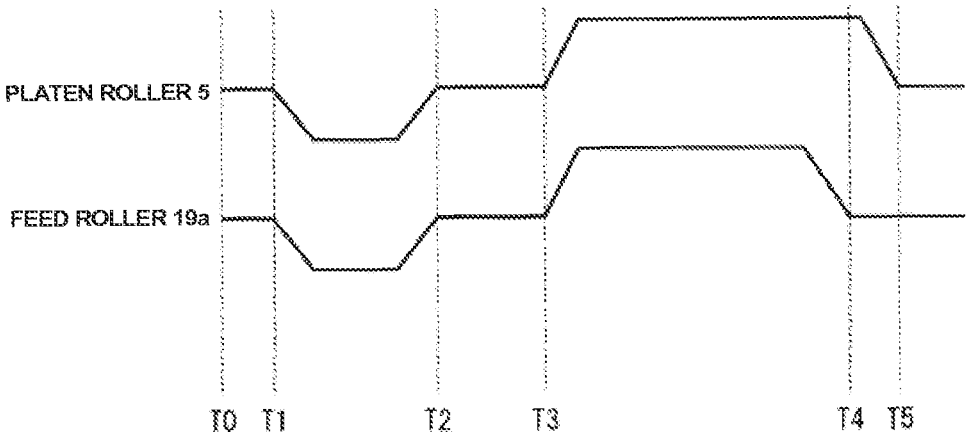
FIG. 4 is a timing diagram illustrating how the controller controls a platen roller and a feed roller.

FIG. 4 is a timing diagram illustrating how the controller 300 controls rotation of the platen roller 5 and rotation of the feed roller 19*a*. With reference to FIG. 4, how the controller 300 of the printer 100 controls rotation after printing based on print data is once finished will be described exemplarily. With reference to FIG. 4, the controller 300 controls rotation of the platen roller 5 and the feed roller 19*a* between the time T0 and the time T5. The time T0 shows the time at which printing based on print data is finished. The time T1 shows the time at which the controller 300 starts to rotate the rollers (the platen roller 5 and the feed roller 19*a*) in the negative rotational direction in order to start back-feeding. Here, to back-feed means to convey the label roll paper 1 and the peeled mount paper 22 in the backward direction by the printer 100 in order to return a label to be printed next to a position upstream of the print position (position facing the print head 10). The time T2 shows the time at which the controller 300 stops rotation of the rollers (the platen roller 5 and the feed roller 19*a*) in the negative rotational direction in order to finish back-feeding. The time T3 shows the time at which the controller 300 starts rotating the rollers (the platen roller 5 and the feed roller 19*a*) in the positive rotational direction for printing based on the next print data. The time T4 shows the time at which the controller 300 stops rotation of the feed roller 19*a* in the positive rotational direction. The time T5 shows the time at which the controller 300 stops rotation of the platen roller 5 in the positive rotational direction.

Next, how the controller 300 controls rotation between the respective times will be described. Firstly, between the time T0 and the time T1, the controller 300 stands by without rotating the rollers as a standby time period to start back-feeding. Between the time T1 and the time T2, the controller 300 rotates the rollers (the platen roller 5 and the feed roller 19*a*) in the negative rotational direction in order to start back-feeding. After finishing back-feeding, between the time T2 and the time T3, the controller 300 stands by without rotating the rollers (the platen roller 5 and the feed roller 19*a*) as a standby time period to start printing based on next print data. If there is next print data, between the time T3 and the time T4, the controller 300 rotates the feed roller 19*a* in the positive rotational direction to print based on the next print data. When the feed roller 19*a* is rotated in the positive rotational direction, the peeled mount paper 22 is conveyed in the forward direction. Further, between the time T3 and the time T5, the controller 300 rotates the platen roller 5 in the positive rotational direction to print based on the next print data. When the platen roller 5 is rotated in the positive rotational direction, the label roll paper 1 is conveyed in the forward direction.

As shown in FIG. 4, at a time of the time T4, the controller 300 stops rotation of the feed roller 19*a*. Further, after a predetermined time period passes after the time T4, the controller 300 stops rotation of the platen roller 5 at a time of the time T5. The controller 300 controls rotation as described above such that the feed amount of the peeled mount paper 22 conveyed in the forward direction is smaller than the feed amount of the label roll paper 1 (mount paper to which labels are attached) conveyed in the forward direction.

Figure 5:
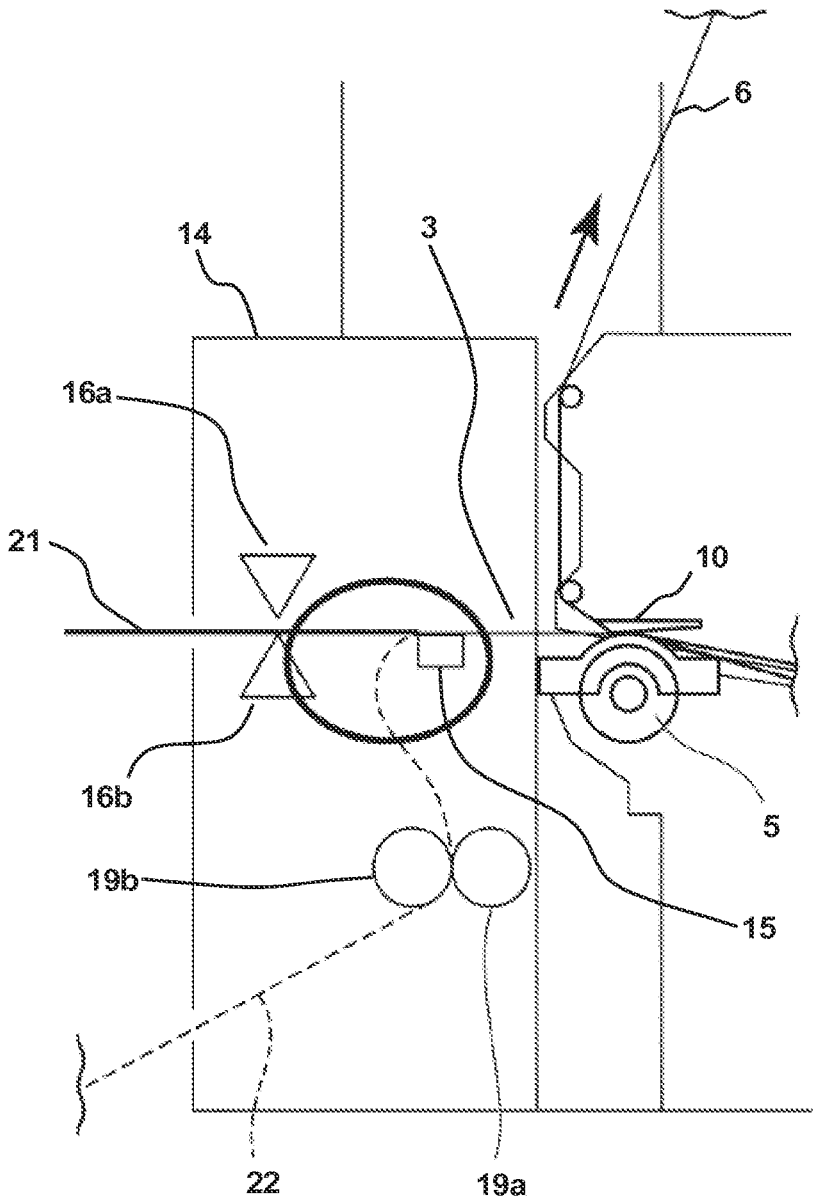
FIG. 5 is a diagram showing the shapes of a peeled label and a peeled mount paper in the printer of the embodiment.

FIG. 5 is a diagram showing the shapes of the peeled label 21 and the peeled mount paper 22 in the printer 100 as a result of rotation controlled by the controller 300 as shown in FIG. 4. FIG. 5 shows part of the printer 100 in the vicinity of the peeling unit 14. As shown in FIG. 5, when the controller 300 controls rotation as described above, in the waiting state to wait for the peeled label 21 to be peeled, the peeled mount paper 22 near the peeling bar 15 is slack and held (see thick frame of FIG. 5). Since the slack shape of the peeled mount paper 22 is kept, it is possible to decrease the possibility of a bend of the peeled mount paper 22 held by the peeling bar 15.

Figure 6:
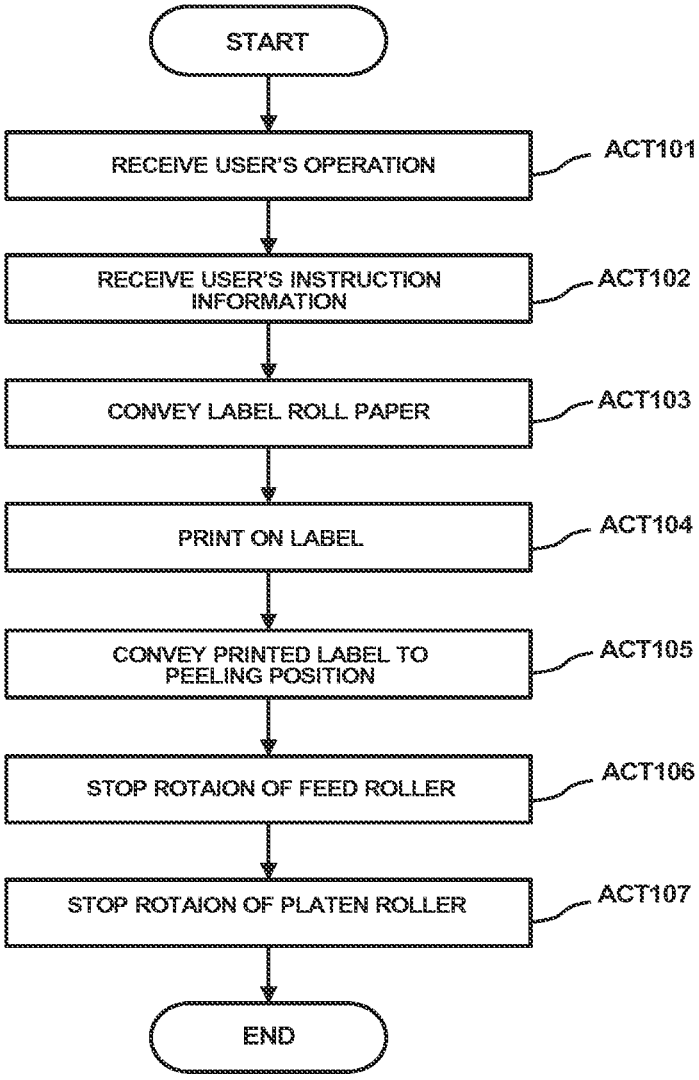
FIG. 6 is a flowchart showing the flow of processing by the controller.

FIG. 6 is a flowchart showing the flow of processing by the controller 300 according to this embodiment. As shown in FIG. 6, in ACT101, the display unit 200 receives an operation by a user. When a user operates the display unit 200 to input instruction information, the display unit 200 outputs the input instruction information to the controller 300. For example, a user inputs a label-issue instruction as the instruction information. In ACT102, the controller 300 functions as the obtaining processor 302, and thereby obtains instruction information from the user. In ACT103, the controller 300 functions as the control processor 303, and thereby rotates the platen roller 5 and the feed roller 19*a* in the positive rotational direction based on the instruction information from the user. The controller 300 rotates the platen roller 5 and the feed roller 19*a*, and thereby conveys the label roll paper 1 in the forward direction. When the label roll paper 1 is conveyed in the forward direction, a label-to-be-printed of the label roll paper 1 reaches the position of a print mechanism.

Next, in ACT104, the controller 300 functions as the control processor 303, and thereby controls behaviors of the print mechanism. The print head 10 of the print mechanism prints, for example, a bar code on the label of the conveyed label roll paper 1 based on print data. After the printing, in ACT105, the controller 300 functions as the control processor 303, and thereby rotates the platen roller 5 and the feed roller 19*a* in the positive rotational direction. The controller 300 rotates the platen roller 5 and the feed roller 19*a*, and thereby conveys the printed label to the peeling position. After the printed label is conveyed to the peeling position, in ACT106, the controller 300 functions as the control processor 303, and thereby stops rotation of the feed roller 19*a*. The printed label except for its tail edge portion is peeled from the mount paper by the peeling bar 15 of the peeling unit 14. After a predetermined time period passes after rotation of the feed roller 19*a* is stopped, in ACT107, the controller 300 functions as the control processor 303, and thereby stops rotation of the platen roller 5.

According to the above-mentioned printer 100, it is possible to decrease the possibility of occurrence of printing failures. In other words, according to the controls of the printer 100 of this embodiment, the feed amount (feed amount of the peeled mount paper 22 when the feed roller 19*a* is rotated in the positive rotational direction) of the peeled mount paper 22 conveyed in the forward direction by the feed roller 19*a* is smaller than the feed amount (feed amount of the label roll paper 1 when the platen roller 5 is rotated in the positive rotational direction) of the label roll paper 1 (mount paper to which labels are attached) conveyed in the forward direction by the platen roller 5. Specifically, the controller 300 of the printer 100 stops rotation of the feed roller 19*a*, and then stops rotation of the platen roller 5 after a predetermined time period passes. As a result of this control process, in the waiting state to wait for the peeled label 21 to be peeled, the peeled mount paper 22 near the peeling bar 15 can be slack. So it is possible to decrease the possibility of a bend of the peeled mount paper 22 held by the peeling bar 15 by making the peeled mount paper 22 slack. As a result, variation of a contact load between the peeling bar 15 and the label roll paper 1 is reduced. As a result, it is possible to decrease the possibility of occurrence of printing failures.

Hereinafter, modifications of the printer 100 will be described. The control of the controller 300, which functions as the control processor 303, is not necessarily be limited to the above-mentioned control. The following controls are modifications of the control of the controller 300. According to Modification 1, the controller 300 controls the platen roller 5 and the feed roller 19*a* to decrease the conveyance speed of the peeled mount paper 22 conveyed by the feed roller 19*a*, the conveyance speed being lower than the conveyance speed of the mount paper to which labels are attached conveyed by the platen roller 5 as the first conveyance unit, in order to make the peeled mount paper 22 slack. Further, the controller 300 controls the platen roller 5 and the feed roller 19*a* to stop conveyance of the mount paper conveyed by the platen roller 5 and conveyance of the mount paper conveyed by the feed roller 19*a* after a predetermined time period passes after the slowdown. According to Modification 2, the controller 300 controls the platen roller 5 and the feed roller 19*a* to convey the mount paper by a predetermined feed amount in the backward direction by the feed roller 19*a* after stopping conveyance of the mount paper, to which labels are attached, conveyed by the platen roller 5 and conveyance of the peeled mount paper 22 conveyed by the feed roller 19*a*, in order to make the peeled mount paper 22 slack. According to Modification 3, the controller 300 controls the platen roller 5 and the feed roller 19*a* to increase the conveyance speed of the mount paper, to which labels are attached, conveyed by the platen roller 5, the conveyance speed being higher than the conveyance speed of the mount paper conveyed by the feed roller 19*a*, in order to make the peeled mount paper 22 slack. Further, the controller 300 controls the platen roller 5 and the feed roller 19*a* to stop conveyance of the mount paper conveyed by the platen roller 5 and conveyance of the mount paper conveyed by the feed roller 19*a* after a predetermined time period passes after increasing the conveyance speed. Hereinafter, Modifications will be described in detail.

Modification 1

After printing, the controller 300 decreases the conveyance speed of the peeled mount paper 22 conveyed by the feed roller 19*a*, the conveyance speed being lower than the conveyance speed of the mount paper, to which labels are attached, conveyed by the platen roller 5. In other words, the controller 300 controls the feed roller 19*a* and the platen roller 5 to decrease the rotational speed of the feed roller 19*a* lower than the rotational speed of the platen roller 5. Further, the controller 300 stops conveyance of the mount paper conveyed by the platen roller 5 and conveyance of the mount paper conveyed by the feed roller 19*a* after a predetermined time period passes after the conveyance speed is decreased. In other words, the controller 300 stops rotation of the platen roller 5 and the feed roller 19*a* after a predetermined time period passes after the rotational speed is decreased. Specifically, when a printed label is conveyed to the peeling position, for example, in ACT106 of FIG. 6, the controller 300 functions as the control processor 303, and thereby decreases the rotational speed of the feed roller 19*a* below the rotational speed of the platen roller 5. As a result, the conveyance speed of the peeled mount paper 22 conveyed by the feed roller 19*a* becomes lower than the conveyance speed of the label roll paper 1 conveyed by the platen roller 5. Further, for example, in ACT107 of FIG. 6, the controller 300 stops rotation of the platen roller 5 and the feed roller 19*a* approximately simultaneously after a predetermined time period passes after slowing down rotation of the feed roller 19*a*. In other words, the controller 300 stops conveyance of the peeled mount paper 22 by the feed roller 19*a* and conveyance of the label roll paper 1 by the platen roller 5.

The printer 100 of Modification 1 controls rotation such that the feed amount of the peeled mount paper 22 conveyed in the forward direction by the feed roller 19*a* is smaller than the feed amount of the label roll paper 1 (mount paper to which labels are attached) conveyed in the forward direction by the platen roller 5. As a result of this control process, in the waiting state to wait for the peeled label 21 to be peeled, the peeled mount paper 22 near the peeling bar 15 can be slack. So it is possible to decrease the possibility of a bend of the peeled mount paper 22 held by the peeling bar 15 by making the peeled mount paper 22 slack. As a result, variation of a contact load between the peeling bar 15 and the label roll paper 1 is reduced. As a result, it is possible to decrease the possibility of occurrence of printing failures.

Modification 2

The controller 300 approximately simultaneously stops conveyance of the mount paper, to which labels are attached, conveyed by the platen roller 5 and conveyance of the peeled mount paper 22 conveyed by the feed roller 19*a*. In other words, the controller 300 approximately simultaneously stops rotation of the platen roller 5 and rotation of the feed roller 19*a*. Further, after stopping the conveyance, the controller 300 controls the feed roller 19*a* to convey the mount paper by a predetermined feed amount in the backward direction. In other words, after stopping the rotation, the controller 300 rotates the feed roller 19*a* by a predetermined rotational amount in the negative rotational direction. Specifically, when a printed label is conveyed to the peeling position, for example, in ACT106 of FIG. 6, the controller 300 functions as the control processor 303, and thereby approximately simultaneously stops rotation of the platen roller 5 and rotation of the feed roller 19*a*. In other words, the controller 300 stops conveyance of the label roll paper 1 by the platen roller 5 and conveyance of the peeled mount paper 22 by the feed roller 19*a*. After that, for example, in ACT107 of FIG. 6, the controller 300 rotates only the feed roller 19*a* by a predetermined rotational amount in the negative rotational direction. The predetermined rotational amount may be previously set or may be different depending on the gap.

The printer 100 of Modification 2 controls rotation such that the feed amount of the peeled mount paper 22 conveyed in the forward direction by the feed roller 19*a* is smaller than the feed amount of the label roll paper 1 (mount paper to which labels are attached) conveyed in the forward direction by the platen roller 5. Specifically, the feed amount of the platen roller 5 until the stop of the rotation is approximately the same as the feed amount of the feed roller 19*a* until the stop of the rotation. Note that, as described above, the feed roller 19*a* is rotated in the negative rotational direction at last. As a result, eventually, the feed amount of the peeled mount paper 22 conveyed in the forward direction by the feed roller 19*a* is smaller than the feed amount of the label roll paper 1 (mount paper to which labels are attached) conveyed in the forward direction by the platen roller 5. As a result of this control process, in the waiting state to wait for the peeled label 21 to be peeled, the peeled mount paper 22 near the peeling bar 15 can be slack. So it is possible to decrease the possibility of a bend of the peeled mount paper 22 held by the peeling bar 15 by making the peeled mount paper 22 slack. As a result, variation of a contact load between the peeling bar 15 and the label roll paper 1 is reduced. As a result, it is possible to decrease the possibility of occurrence of printing failures.

Modification 3

After printing, the controller 300 increases the conveyance speed of the mount paper, to which labels are attached, conveyed by the platen roller 5, the conveyance speed being higher than the conveyance speed of the mount paper conveyed by the feed roller 19*a*. In other words, the controller 300 controls the feed roller 19*a* and the platen roller 5 to increase the rotational speed of the platen roller 5 higher than the rotational speed of the feed roller 19*a*. Further, the controller 300 stops conveyance of the mount paper conveyed by the platen roller 5 and conveyance of the mount paper conveyed by the feed roller 19*a* after a predetermined time period passes after the conveyance speed is increased. In other words, the controller 300 stops rotation of the platen roller 5 and the feed roller 19*a* after a predetermined time period passes after the rotational speed is increased. Specifically, when a printed label is conveyed to the predetermined position, for example, in ACT106 of FIG. 6, the controller 300 functions as the control processor 303, and thereby increases the rotational speed of the platen roller 5 higher than the rotational speed of the feed roller 19*a*. As a result, the conveyance speed of the label roll paper 1 conveyed by the platen roller 5 becomes higher than the conveyance speed of the peeled mount paper 22 conveyed by the feed roller 19*a*. Further, for example, in ACT107 of FIG. 6, the controller 300 stops rotation of the platen roller 5 and the feed roller 19*a* approximately simultaneously after a predetermined time period passes after speeding up rotation of the platen roller 5. In other words, the controller 300 stops conveyance of the peeled mount paper 22 by the feed roller 19*a* and conveyance of the label roll paper 1 by the platen roller 5.

The printer 100 of Modification 3 controls rotation such that the feed amount of the peeled mount paper 22 conveyed in the forward direction by the feed roller 19*a* is smaller than the feed amount of the label roll paper 1 (mount paper to which labels are attached) conveyed in the forward direction by the platen roller 5. As a result of this control process, in the waiting state to wait for the peeled label 21 to be peeled, the peeled mount paper 22 near the peeling bar 15 can be slack. So it is possible to decrease the possibility of a bend of the peeled mount paper 22 held by the peeling bar 15 by making the peeled mount paper 22 slack. As a result, variation of a contact load between the peeling bar 15 and the label roll paper 1 is reduced. As a result, it is possible to decrease the possibility of occurrence of printing failures.

The controller 300 functioning as the control processor 303 may behave as follows depending on pitch lengths of a plurality of labels attached to the label roll paper 1. The pitch length has a length from the front edge of a certain label (for example, first label) attached to the mount paper of the label roll paper 1 to the front edge of an attached label (for example, second label) next to the certain label. The controller 300 controls, depending on the pitch length, the difference between the feed amount of the label roll paper 1 conveyed in the forward direction and the feed amount of the peeled mount paper 22 conveyed in the forward direction. Hereinafter, the difference between the feed amount of the label roll paper 1 and the feed amount of the peeled mount paper 22 will be simply referred to as feed amount difference. More specifically, the controller 300 makes the feed amount difference larger as the pitch length is larger. The larger the feed amount difference, the larger the slack amount of the label roll paper 1. In other words, the larger the pitch length, the larger the slack amount. Note that the feed amount difference can be zero. Further, the pitch length may be input by a user or measured by a sensor.

In the printer 100, the controller 300 functioning as the control processor 303 includes a recording unit that records a table, in which pitch lengths and feed amount differences are registered in association with each other. Further, the controller 300 determines a feed amount difference based on a pitch length with reference to the table recorded in the recording unit. After that, the controller 300 controls the time to stop the platen roller 5 and the time to stop the feed roller 19*a*, the determined feed amount difference being provided.

In general, it is considered that the larger the pitch length, the longer the labels attached to the label roll paper 1 in the conveyance direction. Further, in general, it is considered that the smaller the pitch length, the shorter the labels attached to the label roll paper 1 in the conveyance direction. For example, if the pitch length is small and if the slack amount of the label roll paper 1 is too large, the peeled label 21 may stick to the peeled mount paper 22 again. In view of this, as described above, the controller 300 controls the feed amount difference gradually depending on the pitch length. More specifically, the controller 300 increases the slack amount as the pitch length is larger. In this manner, by controlling the slack amount depending on the pitch length, the slack amount of the label roll paper 1 is never increased when the pitch length is small. As a result, the possibility that the peeled label 21 sticks to the peeled mount paper 22 again can be decreased.

The controller 300 functioning as the control processor 303 may determine the slack amount of the peeled mount paper 22 depending on the thickness of the mount paper of the label roll paper 1. For example, the larger the thickness of the mount paper of the label roll paper 1, the larger a bend of the peeled mount paper 22 bent by the peeling bar 15. So in order not to bend the peeled mount paper 22, the slack should be larger as the thickness of the mount paper of the label roll paper 1 is larger. In view of this, if the thickness of the mount paper of the label roll paper 1 is equal to or larger than a predetermined threshold, the controller 300 functioning as the control processor 303 increases the slack amount of the peeled mount paper 22. The slack amount may be any amount as long as the sensor 16 does not detect presence/absence of the peeled label 21 erroneously. If the slack amount is large, for example, in this embodiment, the time period from the stop of the feed roller 19*a* to the stop of the platen roller 5 should be longer than the predetermined time in ACT107 of FIG. 6, for example. Meanwhile, if the thickness of the mount paper of the label roll paper 1 is smaller than the predetermined threshold, the controller 300 functioning as the control processor

303 reduces the slack amount of the peeled mount paper 22. If the slack amount is reduced, for example, in this embodiment, the time period from the stop of the feed roller 19*a* to the stop of the platen roller 5 should be shorter than the predetermined time in ACT107 of FIG. 6, for example.

According to at least one of the above-mentioned embodiments, the printer 100 includes the platen roller 5 as a first conveyance unit, the print head 10, the peeling unit 14, the feed roller 19*a* as a second conveyance unit, and the controller 300. The platen roller 5 conveys the label roll paper, in which labels are attached to the mount paper. The print head 10 prints on the labels of the label roll paper conveyed by the platen roller 5. The peeling unit 14 peels the labels printed by the print head 10 from the mount paper by using the peeling bar 15. The feed roller 19*a* conveys the peeled mount paper 22, from which the labels are peeled by the peeling bar 15 of the peeling unit 14. The controller 300 controls the feed roller 19*a* and the platen roller 5 such that the feed amount of the peeled mount paper 22 conveyed in the forward direction by the feed roller 19*a* is smaller than the feed amount of the label roll paper 1 (mount paper to which labels are attached) conveyed in the forward direction by the platen roller 5. The printer 100 is capable of decreasing the possibility of occurrence of printing failures.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printer comprising:

a conveyance path for a mount paper on which a plurality of labels are attached;

a print unit located along the conveyance path;

a first conveyance unit for the mount paper, located along the conveyance path;

a peeling unit located downstream of the print unit along the conveyance path and configured to peel off a label from the mount paper;

a second conveyance unit for the mount paper, located downstream of the peeling unit along the conveyance path and configured to convey the mount paper after the label has been peeled off from the mount paper; and a controller configured to control the first conveyance unit and the second conveyance unit such that a feed amount of the mount paper conveyed in a forward direction by the second conveyance unit is smaller than a feed amount of the mount paper conveyed in the forward direction by the first conveyance unit.

2. The printer according to claim 1, wherein the controller is configured to control the second conveyance unit to stop conveying the mount paper in the forward direction, and control the first conveyance unit to stop conveying the mount paper in the forward direction if a predetermined time passes after the second conveyance unit has stopped conveying.

3. The printer according to claim 1, wherein the controller is configured to control the second conveyance unit to convey the mount paper in the forward direction with a conveyance speed which is slower than a conveyance speed with which the first conveyance unit conveys the mount paper, and after a predetermined amount of time has passed, control the first conveyance unit and the second conveyance unit to stop conveying the mount paper.

4. The printer according to claim 1, wherein the controller is configured to control the first conveyance unit to convey the mount paper in the forward direction with a conveyance speed which is faster than a conveyance speed with which the second conveyance unit conveys the mount paper, and after a predetermined amount of time has passed, control the first conveyance unit and the second conveyance unit to stop conveying the mount paper.

5. The printer according to claim 1, wherein the controller is configured to control the first conveyance unit and the second conveyance unit to stop conveying the mount paper, and thereafter control the second conveyance unit to convey the mount paper in a backward direction to cause a predetermined amount of slack to be formed in the mount paper between the first conveyance unit and the second conveyance unit.

6. The printer according to claim 1, wherein the controller is configured to control the first conveyance unit and the second conveyance unit such that a difference between the feed amount of the mount paper conveyed in the forward direction by the first conveyance unit and the feed amount of the mount paper conveyed in the forward direction by the second conveyance unit varies depending on a pitch length, the pitch length being equal to a distance between front edges of adjacent labels attached to the mount paper.

7. The printer according to claim 6, wherein the controller is configured to control the first conveyance unit and the second conveyance unit, such that the difference is increased as the pitch lengths become larger.

8. The printer according to claim 1, wherein the controller is configured to control the first conveyance unit and the second conveyance unit, such that the difference varies depending on a thickness of the mount paper.

9. The printer according to claim 8, wherein the controller is configured to control the first conveyance unit and the second conveyance unit, such that the difference when the thickness of the mount paper is less than a predetermined thickness is less than the difference when the thickness of the mount paper is equal to or larger than the predetermined thickness.

10. A method of controlling a printer in which a mount paper on which a plurality of labels are attached, is conveyed along a conveyance path by first and second conveyance units, the method comprising:

conveying, by the first conveyance unit, the mount paper to a print unit for a label on the mount paper to be printed thereat;

peeling off the printed label from the mount paper;

conveying, by a second conveyance unit, the mount paper after the printed label has been peeled off; and controlling the first conveyance unit and the second conveyance unit, such that a feed amount of the mount paper conveyed in a forward direction by the second conveyance unit is smaller than a feed amount of the mount paper conveyed in the forward direction by the first conveyance unit.

11. The method according to claim 10, wherein the step of controlling includes:

controlling the second conveyance unit to stop conveying the mount paper in the forward direction, and controlling the first conveyance unit to stop conveying the mount paper in the forward direction if a predetermined time passes after the second conveyance unit has stopped conveying.

12. The method according to claim 10, wherein the step of controlling includes:

controlling the second conveyance unit to convey the mount paper in the forward direction with a conveyance speed which is slower than a conveyance speed with which the first conveyance unit conveys the mount paper, and after a predetermined amount of time has passed, controlling the first conveyance unit and the second conveyance unit to stop conveying the mount paper.

13. The method according to claim 10, wherein the step of controlling includes:

controlling the first conveyance unit to convey the mount paper in the forward direction with a conveyance speed which is faster than a conveyance speed with which the second conveyance unit conveys the mount paper, and after a predetermined amount of time has passed, controlling the first conveyance unit and the second conveyance unit to stop conveying the mount paper.

14. The method according to claim 10, wherein the step of controlling includes:

controlling the first conveyance unit and the second conveyance unit to stop conveying the mount paper, and thereafter controlling the second conveyance unit to convey the mount paper in a backward direction to cause a predetermined amount of slack to be formed in the mount paper between the first conveyance unit and the second conveyance unit.

15. The method according to claim 10, wherein the step of controlling includes:

controlling the first conveyance unit and the second conveyance unit such that a difference between the feed amount of the mount paper conveyed in the forward direction by the first conveyance unit and the feed amount of the mount paper conveyed in the forward direction by the second conveyance unit varies depending on a pitch length, the pitch length being equal to a distance between front edges of adjacent labels attached to the mount paper.

16. The method according to claim 15, wherein the step of controlling includes controlling the first conveyance unit and the second conveyance unit, such that the difference is increased as the pitch lengths become larger.

17. The method according to claim 10, wherein the step of controlling includes controlling the first conveyance unit and the second conveyance unit, such that the difference varies depending on a thickness of the mount paper.

18. The method according to claim 17, wherein the step of controlling includes controlling the first conveyance unit and the second conveyance unit, such that the difference when the thickness of the mount paper is less than a predetermined thickness is less than the difference when the thickness of the mount paper is equal to or larger than the predetermined thickness.

* * * * *